US009820598B2

(12) United States Patent
Goldstein

(10) Patent No.: US 9,820,598 B2
(45) **Date of Patent: *Nov. 21, 2017**

(54) CONDIMENT PACKET HOLDER

(71) Applicant: Boscal, LLC, West Hollywood, CA (US)

(72) Inventor: Amy Goldstein, Los Angeles, CA (US)

(73) Assignee: BOSCAL, LLC, West Hollywood, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/376,395

(22) Filed: Dec. 12, 2016

(65) Prior Publication Data

US 2017/0086612 A1 Mar. 30, 2017

Related U.S. Application Data

(63) Continuation-in-part of application No. 14/313,788, filed on Jun. 24, 2014, now Pat. No. 9,517,877.

(51) Int. Cl.

| | |
|---|---|
| ***B65D 1/40*** | (2006.01) |
| ***A47G 23/00*** | (2006.01) |
| ***B65D 25/20*** | (2006.01) |
| ***B65D 67/02*** | (2006.01) |
| ***B65D 85/72*** | (2006.01) |

(52) U.S. Cl.

CPC ..... *A47G 23/00* (2013.01); *B65D 25/20* (2013.01); *B65D 67/02* (2013.01); *B65D 85/72* (2013.01)

(58) Field of Classification Search

CPC ..... B65D 85/72; B65D 67/02; B65D 25/20

USPC ..... 220/737, 605, 628, 631, 633, 634, 635, 220/636, 638, 648, 647, 646

See application file for complete search history.

(56) References Cited

U.S. PATENT DOCUMENTS

| | | | | |
|---|---|---|---|---|
| 4,206,842 | A | 6/1980 | Burridge, Jr. | |
| 4,860,891 | A | 8/1989 | Biggio | |
| D321,815 | S | 11/1991 | Bowdler | |
| 1,907,884 | A | 5/1993 | Sexton | |
| D477,188 | S | 7/2003 | Faria | |
| 7,980,406 | B2 | 7/2011 | Liu | |
| 8,066,148 | B2 * | 11/2011 | Garahan | A45F 5/02 220/737 |
| 2003/0019871 | A1 | 1/2003 | Nance | |
| 2004/0200850 | A1 | 10/2004 | Fields | |
| 2007/0102432 | A1 | 5/2007 | Keller | |
| 2007/0130829 | A1 | 6/2007 | Barnhill | |
| 2011/0204066 | A1 * | 8/2011 | Madrid | B65D 23/00 220/603 |
| 2011/0248033 | A1 | 10/2011 | Mehrvijeh | |

(Continued)

FOREIGN PATENT DOCUMENTS

| | | |
|---|---|---|
| JP | 8258834 | 10/1996 |
| JP | 2012240720 | 12/2012 |

*Primary Examiner* — Fenn C Mathew
*Assistant Examiner* — Don M Anderson
(74) *Attorney, Agent, or Firm* — Cislo & Thomas, LLP

(57) ABSTRACT

A holder for a single-serving condiment packet that allows an opened packet to maintain an upright position without spilling its inner contents and also without having the opening of the open packet touch any part of the holder. The single-serving condiment packet holder has a thin three-dimensional cavity which is defined by one or more internal sidewalls. The holder may also have sidewalls, a base side, and a top side that is any geometric shape. A clip may be used to suspend the holder.

8 Claims, 4 Drawing Sheets

(56) References Cited

U.S. PATENT DOCUMENTS

| | | | | |
|---|---|---|---|---|
| 2012/0034031 | A1 | 2/2012 | Henry et al. | |
| 2013/0119103 | A1 | 5/2013 | Mango | |
| 2013/0153578 | A1* | 6/2013 | Mansell | B65D 5/5059 220/556 |

* cited by examiner

CONDIMENT PACKET HOLDER

CROSS REFERENCE TO RELATED APPLICATIONS

This patent application is a continuation-in-part application of U.S. patent application Ser. No. 14/313,788, filed Jun. 24, 2014, which application is incorporated in its entirety here by this reference.

TECHNICAL FIELD

This invention relates generally to a holder that keeps a single-serving condiment packet upright, and more specifically by using a thin cavity in the holder.

BACKGROUND

The conventional, single-serving condiment packet has provided consumers vendors with many conveniences in terms of portability and portion-control over the years, and for that reason, many restaurants and foodservice operators are loyal to the single-serving packets. However, one of the frustrations of those condiment packets is that there is no easy way for the packet to stand alone without spilling once it is opened, especially for most fluid condiments such as sauces, dressings, syrups, and the like, or small solid particulates, such as sugar, salt, pepper, and the like. Furthermore, for many types of cuisine, the condiment is best experienced Then used in only small amounts at a time. Therefore, a user may open the condiment packet but not use all of its contents immediately. Unfortunately, the result is usually undesirable spilling and contamination of the opening of the packet when the packet is placed horizontally.

There has been a long felt need for resolving the weaknesses of the conventional single-serving, condiment packet. However, to the Applicant's knowledge, nobody has attempted to address the problems that consumers face when dealing with opened but unfinished condiment packets. For example, consumers try to place opened but unfinished packets on an unused eating utensil, the plate, or some other structure on the table. But these are commonly knocked off and spilled. Vendors do not appear to be willing to change the packet styles. Most likely because of the enduring popularity and lower manufacturing costs of the single-serving condiment packets, consumers and vendors still overwhelmingly use them over their newer counterparts. Still, there has yet to be an innovative product that would simply and effectively resolve the problem of the single-serving condiment packet's inability to stand to avoid spilling and becoming contaminated.

Current condiment packet holders are designed to hold multiple condiment packets in bulk so that condiments are readily available to customer without having to refill the condiments because vendors want to reduce the amount of time their servers spend refilling the condiment packet holders. Therefore, the dimensions of current condiment packet holders tend to be large enough to hold a plurality of condiment packets within their cavities.

Accordingly, there is a need in the art for a device that are properly dimensioned to hold a single-serving condiment packet upright in a way that does not contaminate the condiment and keeps the condiment from spilling after it has been opened.

SUMMARY OF INVENTION

The present invention is directed to an apparatus that is capable of holding a single-serving condiment packet and supports an opened packet in maintaining an upright position without spilling its inner contents or having the opening of the open packet touch any part of the holder. In the preferred embodiment, the single-serving condiment packet holder comprises one or more internal sidewalls, which define an opening in fluid communication with a three-dimensional cavity. A preferable construction would be an isosceles trapezoidal-shaped holder with a three-dimensional cavity large enough for receiving only one single-serving condiment packet.

Because the invention is aimed towards holding up thin packets with condiments that are fluids or small solid particulates because of their likelihood of spilling when the packet is on its side, the three-dimensional cavity should be only large enough to hold the condiment packet vertically so as to leave very little room for the packet to tip over. Therefore, the size of the three-dimensional cavity is critical and preferably substantially the same width and thickness as the packet to be held so that once the packet were to fit inside the three-dimensional cavity, the opening of the packet where the condiment would be dispensed would not be able to touch the apparatus as to contaminate the opening of the packet.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The term condiment packet refers to a range of single serving packets, for example, packets of a condiment that can be added to food or beverages to add, change, and/or enhance flavoring, color, spice, or some other characteristic of the food or beverage. By way of example only, condiments include, but are not limited to, soy sauce, hot sauce, syrup, dressings, mustard, mayonnaise, relish, salt, pepper, sugar, and the like.

The term rectangular means any quadrilateral with four right angles, including a square.

Figure 1:
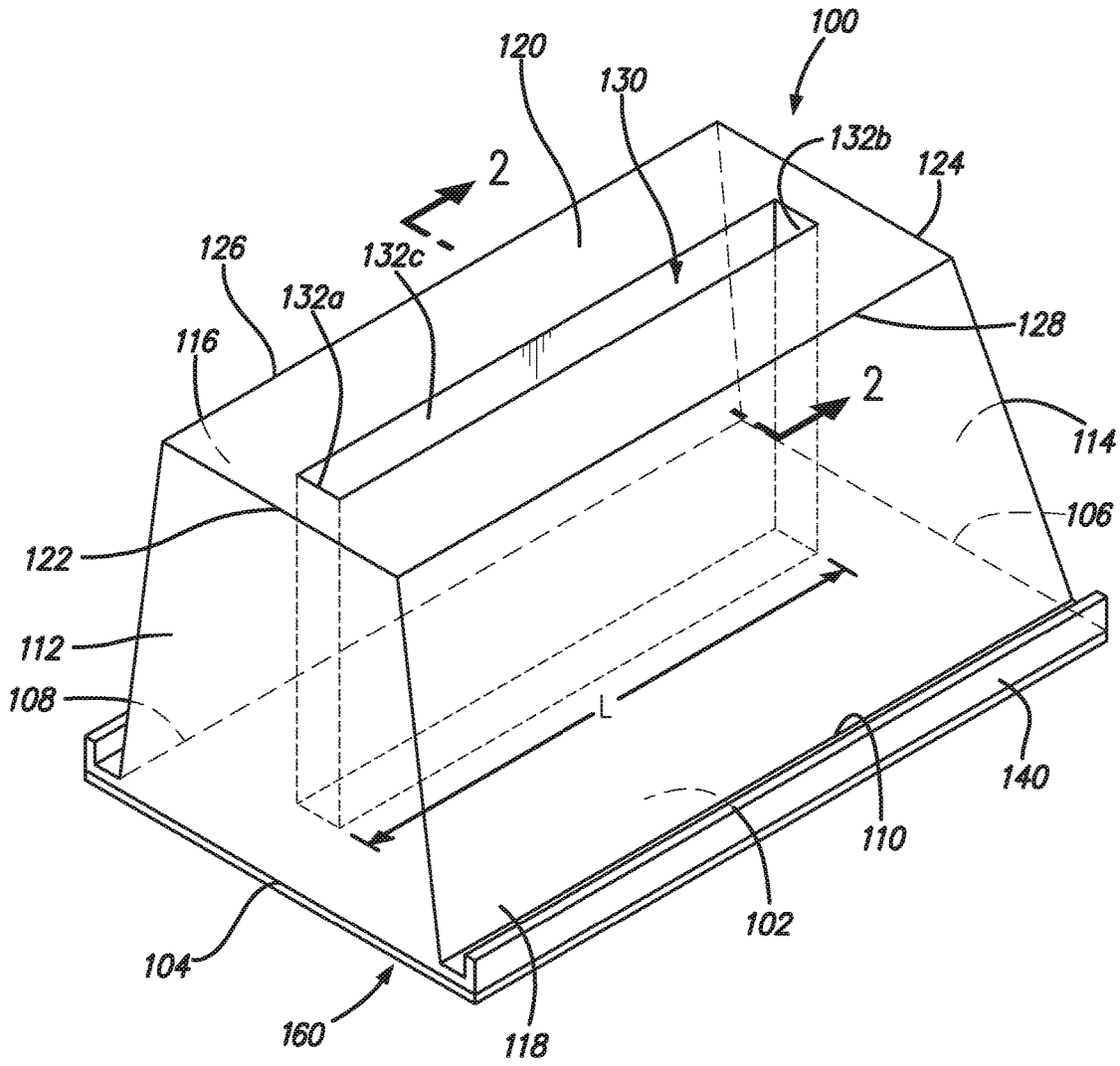
FIG. 1 shows a perspective view of an embodiment of the condiment packet holder.
Figure 4:
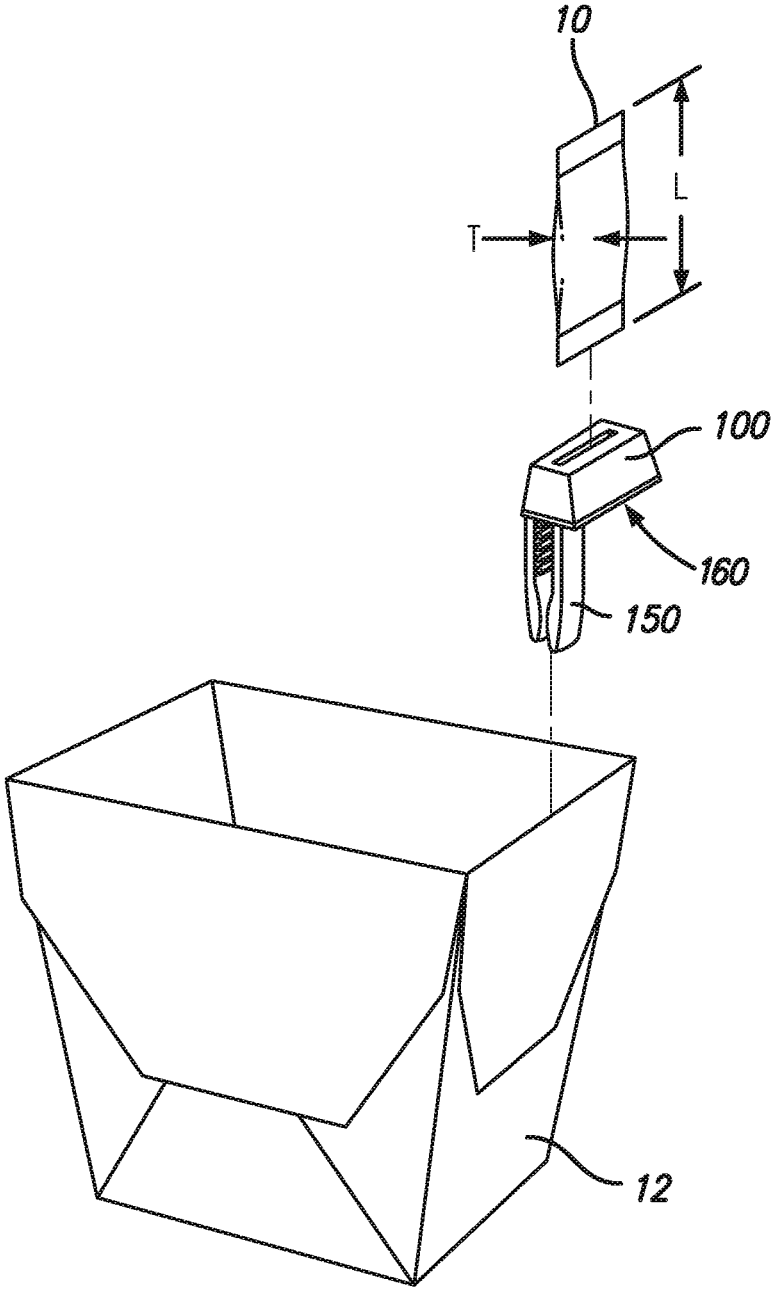
FIG. 4 shows how the condiment packet holder can be used.

FIG. 1 is a perspective view of a preferred embodiment of a packet holder 100 comprising a base side 102, a plurality of walls 112, 114, 116, 118 extending from the base 102, a top side 120 opposite the base 102 and adjacent to the plurality of walls 112, 114, 116, 118, and an opening 130 on the top side 120, wherein the opening 130 is large enough to receive a single condiment packet in the upright configuration. FIG. 4 shows a condiment packet 10 in its upright configuration being inserted into a holder 100.

In the preferred embodiment, the base side 102 has a first edge 104, a second edge 106, a third edge 108, and a fourth edge 110, wherein the first edge 104 is opposite to the second edge 106, the third edge 108 is adjacent and perpendicular to the first and second edges 104, 106 and the fourth edge 110 is opposite to the third edge 108 and adjacent and perpendicular to the first and second edges 104, 106. However, the base side 102 may take the form of any shape, such as a circle, oval, star, pentagon, hexagon, and the like.

Also, the base side 102 preferably has a width of approximately 15 mm to approximately 50 mm and a length of approximately 15 mm to approximately 85 mm, and the holder 100 preferably has a height of approximately 15 mm to approximately 60 mm. More preferably, the base side 102 has a width of approximately 20 mm to approximately 40 mm and a length of approximately 20 mm to 70 mm, and the holder 100 has a height of approximately 20 mm to approximately 50 mm. In one embodiment, the rectangular base side 102 has a width of approximately 36 mm and a length of approximately 60 mm, and the holder 100 has a height of approximately 35 mm.

In the preferred embodiment, a first sidewall 112 may be adjacent o the first edge 104 of the base side 102 and a second sidewall 114 may be adjacent to the second edge 106 of the base side 102. Preferably, the first and second sidewalls 112, 114 are non-perpendicular the base side 102. More preferably, the first and second sidewalls 112, 114 taper toward each other as they move toward the top side 120. A third sidewall 116 may be adjacent to the third edge 108 of the base side 102 and a fourth sidewall 118 may be adjacent to the fourth edge 110 of the base side 102. Preferably, the third and fourth sidewalls 116, 118 are non-perpendicular to the base side 102. More preferably, the third and fourth sidewalls 116, 118 taper toward each other as they move towards the top side 120.

In the preferred embodiment, the top side 120 may also be rectangular in shape having a first edge 122, a second edge 124, a third edge 126, and a fourth edge 128, wherein the first, second, third, and fourth edges 122, 124 126, 128 of the top side 120 are adjacent to the first, second, third, and fourth sidewalls 112, 114, 116, 118, respectively. In the preferred embodiment, the base side 102 is larger than and parallel to the top side 120 due to the tapering nature of the sidewalls 112, 114, 116, 118. However, the top side 120 can also take on any shape like the base side 102. In addition, the top side 120 does not have to he parallel to the base side 102. Furthermore, the top side 120 and the base side 102 need not even he the same shape.

The top side 120 comprises an opening leading into a cavity or open space 130. The opening and the cavity dimensions are critically important to the invention because the holder 100 is designed to hold one, single-serving condiment packet. Since single-serving condiment packets come in different sizes, the dimensions of the opening and cavity can vary to accommodate the different packet sizes, but should remain small enough to hold one packet upright at an angle of approximately 45 degrees to approximately 90 degrees relative to the base. Preferably, when the condiment packet is placed in the holder, the angle made between the packet and the base of the holder is between 60 degrees to approximately 90 degrees. More preferably, the angle is between approximately 75 degrees and approximately 90 degrees, 80 degrees and approximately 90 degrees, 85 degrees and approximately 90 degrees, 95 degrees and approximately 90 degrees.

In addition, the cavity should be deep enough that when the packet is placed inside the holder, the packet does not fall over because it is top heavy. Therefore, the most critical dimension is the width W of the opening and the depth D of the cavity.

In the preferred embodiment, the cavity 130 is defined by internal sidewalls 132*a-d*. Preferably, the cavity 130 may have a width W of approximately 5 mm to approximately 15 mm, a length of approximately at least 15 mm, and a depth D of approximately 15 mm to approximately 60 mm. These dimensions are expected to cover the small salt and pepper packages to the larger salad dressing packages that are often sold at fast food restaurants. For any embodiment of the holder, the length L and the depth D of the three-dimensional cavity can be less than or equal to the length and height of the holder 100, respectively.

Figure 2:
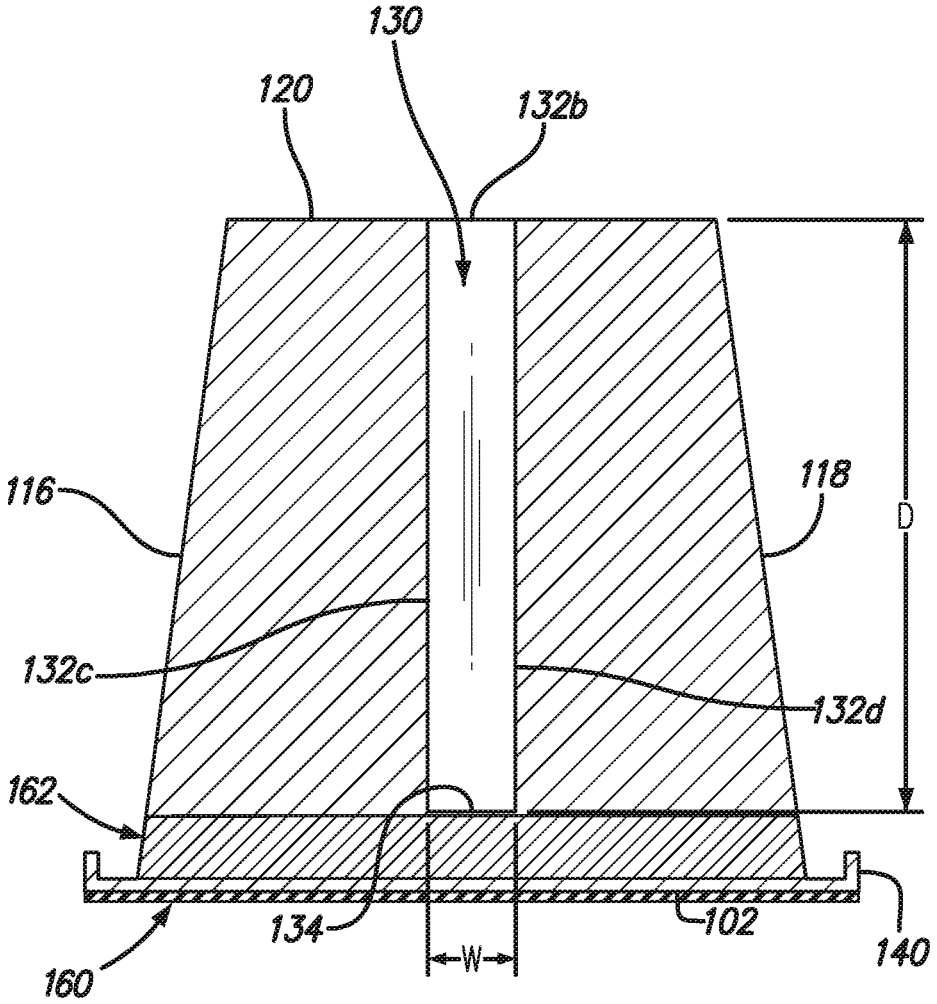
FIG. 2 shows a cross-sectional view of the embodiment shown in FIG. 1 taken along line 2-2.

FIG. 2 shows a cross-sectional view of the packet holder 100 taken through line 2-2 shown in FIG. 1. The holder 100 comprises one or more internal sidewalls 132*a-d*, which define the opening and the cavity 130. As shown, the opening is in fluid communication with the cavity 130. The internal sidewalls 132*a-d* are shown being parallel to each other and perpendicular to the top side 120 and the base side 102. However, any internal sidewall 132*a-d*, or any combination of internal sidewalls 132*a-d*, can be non-parallel to each other or non-perpendicular to the top side 120 or the base side 102. In addition, although each sidewall 112, 114, 116, 118 and each internal sidewall 132*a-d* are shown as the same height, they can be of different heights relative to each other.

There are also many other variations of the embodiment of the holder 100. The base does not have to be rectangular and may be any geometric shape. The top and base sides do not have to be parallel and may even be adjacent on one side. In other words, the top side 120 may not be parallel to the base side 102. The cavity 130 does not have to be rectangular. For example, it could be oval and defined by only one internal sidewall or eye shaped and defined by two internal sidewalls, and the like. The thin cavity 130 may also extend all the way through the side walls 112, 114 so as to form an open channel from one side wall 112 to the other sidewall 114.

In some embodiments, the packet holder 100 may comprise of wire or rod-type frames made of plastic, wood, metal, and the like, and may be absent of any sidewalk. Instead, the holder may be produced by connecting any of the bottom edges 104, 106, 108, 110 to any of the top edges 122, 124, 126, 128 of the holder 100 while still having an opening sufficiently small enough to hold a single condiment packet upright.

Optionally, the condiment packet holder 100 may also have multiple other thin rectangular cavities of the same or similar dimensions. This embodiment would still Larry the spirit of the "single" condiment packet holder in the sense that each three-dimensional cavity is only capable of holding a single condiment packet. Various sizes can be manufactured to cater to the different sized condiment packets, varying from the small pepper packets to the typical soy sauce and ketchup-type packets to the larger salad dressing packets, and everything in between. The holder 100 is designed for use with condiment packet's 10 ratio of the thickness T of the packet (defined as the average distance between the packet's two largest sides in terms of surface area) to the longest edge L of the packet of less than 0.20. Preferably, e ratio of the thickness T to the longest edge L of the packet 10 is approximately 0.05 to 0.16.

In some embodiments, the one or more of the sidewalls 112, 114, 116, 118 may have a lip 140 extending outwardly, and preferably, upwardly from, on, or near one of the edges 104, 106, 108, 110 of the base side 102. This lip 140 can be used to hold additional condiment packets resting on the lip 140 and leaning against the respective sidewall 112, 114, 116, or 118. This is particularly useful in embodiments in which the sidewalls 112, 114, 116, or 118 are non-perpendicular to the base side 102 or taper inwardly toward the top side 120. In such embodiments, the opening and cavity 130 may be optional. Such an embodiment can also prevent the openings of other peoples' condiment packets from touching each other. In addition, such an embodiment can he used by a single user with multiple different condiment packets. For example, a single user may have a ketchup packet, a mustard packet, and a relish packet. Each packet can be placed on a different sidewall 112, 114, 116, or 118, or in the cavity 130.

Furthermore, the surfaces 112 114, 116, 118, 120 of the condiment packet holder 100 may bear any graphic and/or printed matter desired as a consequence of with the holder's promotional nature, and such graphic may be changed depending on the vendor or user's discretion, in accordance with copyright and trademark laws.

In some embodiments, the holder 100 may further comprise a traction surface 160 located underneath the base 102 of the holder. The traction surface 160 allows the holder to better grip or stick to the surface upon which it rests. If used in a moving vehicle, for example, the holder is less likely to slide when the vehicle suddenly accelerates or stops. The traction surface 160 may be made of material that creates friction with hard surfaces. For example, the traction surface 160 may be made of rubber. In some embodiments, the traction surface 160 may comprise textured surface so as to create friction between the holder 100 and the surface upon which it is placed.

In some embodiments, the holder 100 may have a high density area 162 near the base 102. This improves the stability of the holder 100 so as to reduce the propensity of toppling over.

Figure 3:
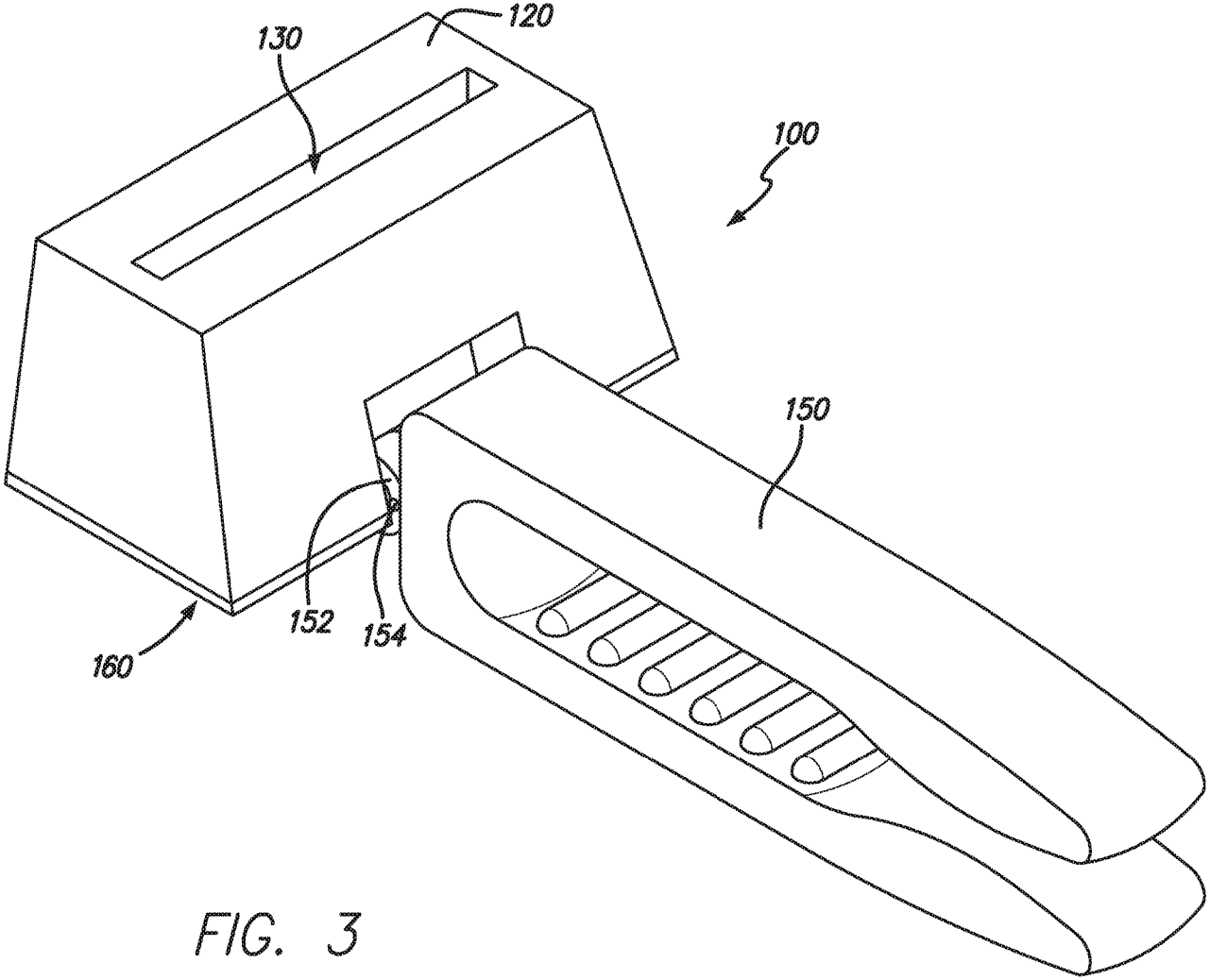
FIG. 3 shows another embodiment of the packet holder with a clip.

In some embodiments, as shown in FIGS. 3 and 4, the holder 100 may further comprise a clip 150 to suspend the holder 100 in the air by attaching the holder 100 to a structure. The clip 150 may be attached to any sidewall 112, 114, 116 118 or base 102. In the preferred embodiment, the clip 150 may be movably attached to the holder 100 in a manner that allows the clip 150 to move from one of the sidewalls 112, 114, 116, 118 to the base 102 to place the clip in a horizontal configuration or a vertical configuration, respectively. For example, the clip 150 may be rotatably connected to the holder though a hinge 152. A locking mechanism 154 can be used to keep the clip 150 in the desired horizontal or vertical position. For example, the locking mechanism 154 may be in the form of one or more protrusions, and the holder 100 may have at least one divot (not shown) that can receive the protrusions. The divot would be positioned so that when the protrusion is seated in one of the divots, the clip 150 is locked in the horizontal position, the vertical position, or some other desired position. The configuration of the locking mechanism 154 may be such that the weight of the holder 100 is insufficient to remove the protrusion out of the divot, but greater force would be able remove the protrusion from the divot. The arrangement of the divot and the protrusion can be reversed so that the divot is on the hinge 152 and the protrusion is on the holder 100. In some embodiments with a clip 150, the lip 140 may be on the sidewalls adjacent to or opposite the clip 150.

The clip 150 can be secured to the sidewalls 112, 114, 116, 118 or to the base 102 in a moveable manner in many different ways. For example, the clip 150 may itself be clipped onto the holder 100 with some other kind of resistance fit mechanism, or secured via screws, adhesives, hook-and-loop fasteners, buttons, magnets, and the like.

The addition of the clip 150 gives the holder 100 more versatility in terms of where it can be placed, rather than being limited to being placed only on a flat surface. For example, the holder 100 can be clipped onto various structures, such as the user's plate, bowl, take-out box, and the like. FIG. 4 shows how the holder 100 can be clipped to a take-out box 12. Passengers in a vehicle, such as a car, ship, plane, train, and the like can clip the holder 100 onto structures, such as the vents, console, cup holder, tray, shelf, ledge, and the like. Depending on the structure to which the holder 100 is attached, the clip 150 can be positioned in the horizontal or vertical configuration.

A method for holding a condiment packet comprises placing the condiment packet 10 into a holder 100 having a thin cavity 130 that is defined by one or more internal sidewalls 132*a-d* or edge(s) that define the opening. After the packet is placed into the cavity 130, the condiment packet still maintains an upright position without spilling its inner contents.

The condiment packet holder 100 of the present disclosure can be manufactured cost effectively. Possible materials that could be used include, but are not limited to, plastic, metal, ceramic, wood, foam, rubber, glass, and the like. Various techniques, such as molding, machining, casting, and the like, can be used.

The foregoing description of the preferred embodiment of he invention has been presented for the purposes of illustration and description. It is not intended to be exhaustive or to he invention to the precise form disclosed. Many modifications and variations are possible in light of the above teaching. It is intended that the scope of the invention not he limited by this detailed description, but by the claims and the equivalents to the claims appended hereto.

What is claimed is:

1. A condiment packet holder, comprising:

a. a rectangular base side having a first edge, a second edge, a third edge, and a fourth edge, wherein the first edge is opposite to the second edge, the third edge is adjacent and perpendicular to the first and second edges, and the fourth edge is opposite to the third edge and adjacent and perpendicular to the first and second edges;

b. a first sidewall adjacent to the first edge of the rectangular base side and a second sidewall adjacent to the second edge of the rectangular base side, wherein the first and second sidewalls are non-perpendicular to the rectangular base side;

c. a third sidewall adjacent to the third edge of the rectangular base side and a fourth sidewall adjacent to the fourth edge of the rectangular base side, wherein the third and fourth sidewalls are non-perpendicular to the rectangular base side;

d. a rectangular top side having a first edge, a second edge, a third edge, and a fourth edge, wherein the first, second, third, and fourth edges of the top side are adjacent to the first, second, third, and fourth sidewalls, respectively, wherein the rectangular base side is larger than and parallel to the rectangular top side;

e. a cavity, which is defined by one or more internal sidewalls, wherein the top side has an opening in fluid communication with the cavity sized to hold one single-serving condiment packet;

f. wherein the rectangular base side has a width of approximately 15 mm to approximately 50 mm and a length of approximately 15 mm to approximately 85 mm, and the holder has a height of approximately 15 mm to approximately 60 mm, and g. wherein the cavity has a width of approximately 5 mm to approximately 15 mm, a length of approximately at least 15 mm, and the cavity has a depth of approximately 15 mm to approximately 60 mm.

2. The condiment packet holder of claim 1, further comprising a clip moveably attached to one of the at least one sidewall or base, wherein the clip is adjustable from a first position to a second position.

3. The condiment packet holder of claim 1, further comprising a lip extending from the rectangular base.

4. The holder in claim 1, wherein the base further comprises a traction surface.

5. The holder in claim 1, wherein one or more sidewall comprises a lip.

6. The holder in claim 5, wherein the lip protrudes from the one or more sidewall near the edge of the base from which the one or more sidewall extends.

7. The holder in claim 1, wherein the base is rectangular having a width of approximately 36 mm and a length of approximately 60 mm, and the holder has a height of approximately 35 mm.

8. The holder in claim 2, wherein the clip is adjustable from a first position on one of the first sidewall, second sidewall, third sidewall, or fourth sidewall to a second position on the base.

* * * * *